United States Patent [19]

Fister

[11] Patent Number: 4,625,400

[45] Date of Patent: Dec. 2, 1986

[54] METHOD OF MAKING A STRIP FOR AN ELECTRICAL CONTACT TERMINAL

[75] Inventor: Julius C. Fister, Hamden, Conn.

[73] Assignee: Olin Corporation, New Haven, Conn.

[21] Appl. No.: 511,364

[22] Filed: Jul. 6, 1983

[51] Int. Cl.[4] ..... H01R 43/02

[52] U.S. Cl. ..... 29/879; 29/875; 228/197; 419/8

[58] Field of Search ..... 29/875, 878, 879; 419/8; 264/165; 427/428; 118/244

[56] References Cited

U.S. PATENT DOCUMENTS

| | | | |
|---|---|---|---|
| 2,691,815 | 10/1954 | Buessenkool et al. | 228/197 |
| 3,002,834 | 10/1961 | Di Pasquale | 419/8 |
| 3,059,331 | 10/1962 | Pflumm | 419/8 X |
| 3,108,871 | 10/1963 | Storchheim | 419/8 |
| 3,152,892 | 10/1964 | Clark | 264/165 X |
| 3,199,176 | 8/1965 | Freudiger et al. | 29/875 |
| 3,377,202 | 4/1968 | Belove | 419/8 X |
| 3,545,078 | 12/1970 | Lightner | 427/428 X |
| 3,627,901 | 12/1971 | Happ . | |
| 3,684,464 | 8/1972 | Happ et al. . | |
| 3,685,134 | 8/1972 | Blue | 29/875 X |
| 3,742,585 | 7/1973 | Wentzell | 29/423 |
| 4,183,611 | 1/1980 | Casciotti et al. . | |

FOREIGN PATENT DOCUMENTS

| | | | |
|---|---|---|---|
| 3133246 | 11/1978 | Japan | 118/244 |

*Primary Examiner*—Howard N. Goldberg
*Assistant Examiner*—Carl J. Arbes
*Attorney, Agent, or Firm*—Howard M. Cohn; Barry L. Kelmachter; Paul Weinstein

[57] ABSTRACT

A method of producing a strip adapted for use as an electrical contact terminal comprising the following steps. First, a strip of relatively flexible substrate material is provided. Then, a substantially continuous strip of powdered metal or metal alloy is deposited onto a surface of the strip to produce the electrical contact terminal.

8 Claims, 2 Drawing Figures

METHOD OF MAKING A STRIP FOR AN ELECTRICAL CONTACT TERMINAL

While the invention is subject to a wide range of applications, it is especially suited for an improved electrical contact having portions plated with a continuous strip of powdered metal to enhance the electrical characteristics thereof.

It is well known in the electrical connector industry that the characteristics of an electrical contact can be selectively improved by having at least a portion of the contact formed from a metal of a particular electrical and/or physical characteristic. For example, it has been well known that the electrical and wear characteristics of contacts can be improved by plating the formed contact with a gold or gold alloy. The plated strip of metal may be adhered to a skived or unskived substrate using techniques such as onlay, inlay, and vapor deposition.

Onlays may be accomplished by depositing a thin foil of metal on a surface of an unskived substrate and adhering the foil to the substrate by applying pressure with or without heat as desired. The inlay is metallurgically bonded into the skived groove of a substrate using compression and/or heat as required. U.S. Pat. Nos. 3,627,901, 3,684,464 and 4,183,611 disclose these types of configurations. This approach of inlaying or onlaying may require elaborate handling techniques of the thin foils which are often less than one-thousandth of an inch in thickness. The processing rate of these processes is less than about 400 ft/min.

Another conventional technique of providing inlayed strips of a different metal from the base metal is vapor deposition. Generally, the strip of metal applied has a thickness of less than about 10,000 angstroms. The thickness of this inlay results in it being porous which may cause a reduction in the effective life of the contact due to interdiffusion.

It is a problem underlying the present invention to provide a method of producing a strip adapted for use as an electrical contact terminal which can be conveniently and efficiently applied.

It is an advantage of the present invention to provide a method of producing a strip adapted for use as an electrical contact terminal which is relatively inexpensive to manufacture.

It is a further advantage of the present invention to provide a method of producing a strip adapted for use as an electrical contact terminal which provides one or more stripes of metal having different electrical and/or mechanical characteristics from the substrate and which can be selectively applied thereto.

It is a yet further advantage of the present invention to provide a method of producing a strip adapted for use as an electrical contact which can be very rapidly produced.

Accordingly, there has been provided a method of producing a strip adapted for use as an electrical contact terminal comprising the following steps. First, a strip of relatively flexible substrate material is provided. Then, a substantially continuous strip of powdered metal or metal alloy is deposited onto a surface of the strip to produce the electrical contact terminal.

The invention and further developments of the invention are now elucidated by means of preferred embodiments shown in the drawings.

Figure 1:
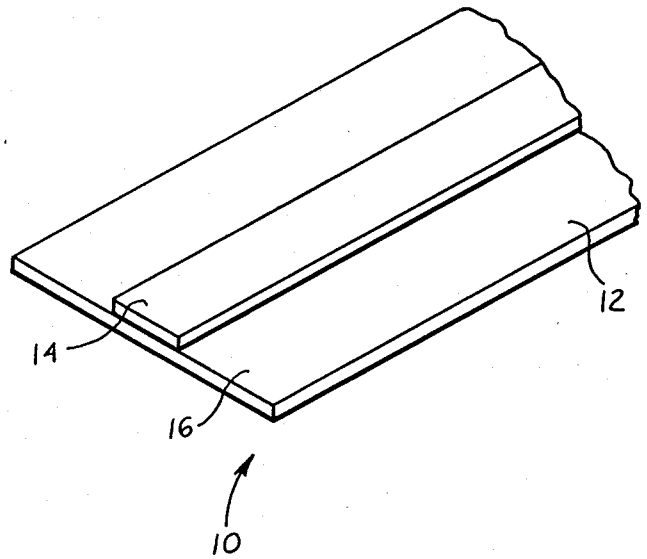
FIG. 1 is a perspective view of a strip of contact forming material.

Referring to FIG. 1, there is illustrated a strip 10 which may be adapted for use as an electrical contact terminal. The strip is formed of a relatively flexible substrate material 12. A substantially continuous strip of powdered metal or alloy 14 is adhered to the surface 16 of the strip 12 to produce an electrical contact terminal having desired electrical and/or physical qualities.

The substrate 12 is preferably a flexible or semi-rigid strip of metal or metal alloy which is suitable for a particular application such as an electrical contact terminal. The substrate may also be formed of an organic or plastic film with a metal or metal alloy laminate adhered thereto. Although a flat surface 16 is illustrated in FIG. 1, it is within the scope of the present invention to skive the substrate and inlay the stripe therein. In electrical applications the substrate generally has a thickness of between about 0.008 to about 0.015 inches.

The onlay strip 14 is comprised of metal or metal alloy powder which may be applied to the metal or metal alloy substrate unaltered or with additional binders or flux agents. The binders or flux agents may be added to the metal or metal alloy powder or particulates to hold the powder particles together and give rigidity, structural strength and cohesion to them. By changing the percentage of binder or flux to powder particles, the stripe 14 may be deposited onto the substrate in the form of an ink or a slurry.

After preparing the powder to form the ink or slurry, it is applied to the substrate 12 using any desired technique such as spraying, brushing or rolling. For example, referring to FIG. 2, a station 19 includes a deposition bath 18 containing metal or metal alloy particles mixed with a binder to form an ink or slurry. A roller 20 rotates in the bath 18 and picks up the material on its surface 21. Then, the roller engages the substrate 12 and deposits a strip of the particles 14 of any desired width and thickness. After the application, the strip passes downstream through rollers 24 which pressure bonds the metal or metal particle layer 14 to the surface 16 of the strip. The rollers compress the particles into the surface to provide adherence as well as uniformity of gauge. The roller helps control the width and thickness of the deposited metal layer 14. The range of widths of the onlay 14 is between about 0.003 inches to full coverage of the substrate. The thickness of the stripe 14 is up to about twenty-thousandths of an inch. Although the onlay may be substantially rectangular, the edges may be thinner and without sharp corners. A significant advantage of the present invention is the ability to deposit the onlay 14 onto the substrate 12 at a rate of up to about 1,000 ft/min. An additional advantage of the present invention is that selected areas of the substrate may have the onlay deposited thereon to form desired shapes including stripes and/or circles.

When a powder metal or alloy is to be deposited onto the substrate, it may be more desirable to apply it to the top layer so that gravity will help it to adhere prior to its compression by the compression rollers. As with the ink or slurry, the powder may be applied by means such as a roller or spray. If the powder were applied to the bottom surface 16 of the substrate as shown in FIG. 2, it may be initially compressed by the wheel 20 so that it may be more positively adhered to the surface.

An important aspect of the present invention is the ability to deposit the onlay in a continuous deposit free of porosity, streaks or blisters. This may be accomplished by any of the techniques described herein.

After the strip leaves rollers 24, it may be annealed to increase the adhesion between the particles and the substrate. Also, the anneal may provide other advantages such as improvement of the diffusion between adjacent particles as well as with the substrate. The particular temperature of the anneal depends on the materials being processed and may extend from about 150° C. to approximately the melting temperature of the metal or alloy powder. If necessary, it may even be above the melting temperature so that the powder might go into a diffusion stage within the liquid phase. In the case of typically used aluminum powder, the annealing temperature would be between about 200° C. to about 600° C. from a few seconds to several hours.

Figure 2:
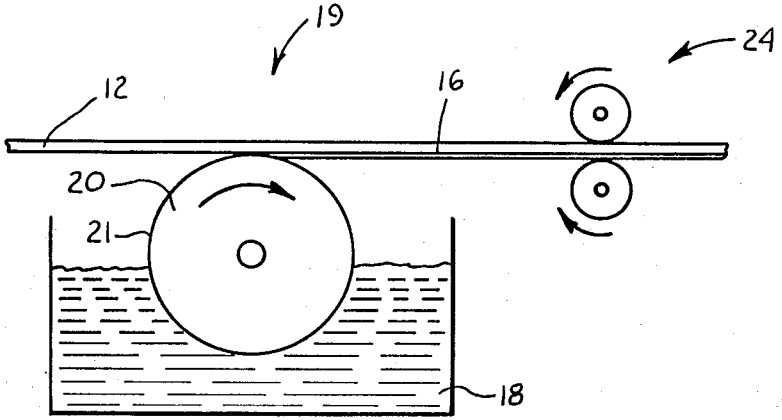
FIG. 2 is a side view of an apparatus adapted to produce the contact strip of the present invention.

Although a single station comprising a single roller in a deposition bath and compression rolls is shown in FIG. 2, it is also within the terms of the present invention to have two or more rollers in the deposition bath to deposit additional stripes as required. Further, two or more stations may be provided so that two or more onlays may be deposited onto the substrate 12, each being a different composition and/or requiring different annealing temperatures. It is further within the terms of the present invention to deposit the onlay on one or both sides of the substrate 12 as required. Also, each of the stations may use different techniques of applying the onlay such as spraying or rolling.

The patents set forth in this application are intended to be incorporated by reference herein.

It is apparent that there has been provided in accordance with this invention a strip adapted for use as an electrical contact terminal which satisfies the objects, means, and advantages set forth hereinabove. While the invention has been described in combination with the embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed:

1. A method of producing a strip adapted for use as an electrical contact terminal, comprising the steps of:

providing a relatively flexible metal or metal alloy substrate;

providing a powdered metal or metal alloy;

adding a binder to the powdered metal or metal alloy to hold the powdered metal or metal alloy together;

depositing the powdered metal or metal alloy with added binder on a first surface of said metal or metal alloy substrate;

pressure bonding said metal or metal alloy powder with added binder to the first surface of said metal or metal alloy substrate; and annealing said substrate with said pressure bonded metal or metal alloy powder at a temperature from about 150° C. up to but not including the melting temperature of said metal or metal alloy powder to further increase the adhesion between the powdered metal or metal alloy and said surface of said metal or metal alloy substrate.

2. The method of claim 1 wherein said step of pressure bonding is effected by rolling.

3. The method of claim 2 including the step of providing said substrate material with a laminate comprising an organic film adhered to a second surface of the metal or metal alloy substrate.

4. The method of claim 1 wherein said step of depositing further comprises the step of applying said powdered metal or metal alloy with the added binder as a slurry.

5. The method of claim 1 wherein said step of depositing further comprises the step of applying said powdered metal or metal alloy with the added binder as an ink.

6. A method of producing a strip adapted for use as an electrical contact terminal, comprising the steps of:

providing a relatively flexible metal or metal alloy substrate, said substrate material having a laminate comprising an organic film adhered to a second surface of the substrate;

providing a powdered metal or metal alloy;

adding a binder to the powdered metal or metal alloy to hold the powdered metal or metal alloy together;

depositing the powdered metal or metal alloy with added binder on a first surface of said metal or metal alloy substrate;

pressure bonding said metal or metal alloy powder with added binder to the first surface of said metal or metal alloy substrate, said step of pressure bonding being effected by rolling; and annealing said substrate with said pressure bonded metal or metal alloy powder at a temperature from about 150° C. up to but not including the melting temperature of said metal or metal alloy powder to further increase the adhesion between the powdered metal or metal alloy and said surface of said metal or metal alloy substrate.

7. The method of claim 6 wherein said step of depositing further comprises the step of applying said powdered metal or metal alloy with the added binder as an ink.

8. The method of claim 6 wherein said step of depositing further comprises the step of applying said powdered metal or metal alloy with the added binder as a slurry.

* * * * *